US008172221B2

(12) United States Patent
Mönch et al.

(10) Patent No.: US 8,172,221 B2
(45) Date of Patent: May 8, 2012

(54) DEVICE FOR THE SEPARATION OF A SHEET PRODUCT

(75) Inventors: Mario Mönch, Unterhaching (DE); Erwin Demmeler, Memmingen (DE)

(73) Assignee: Giesecke & Devrient GmbH, Munich (DE)

( * ) Notice: Subject to any disclaimer, the term of this patent is extended or adjusted under 35 U.S.C. 154(b) by 0 days.

(21) Appl. No.: 12/677,442

(22) PCT Filed: Sep. 10, 2008

(86) PCT No.: PCT/EP2008/007427

§ 371 (c)(1),
(2), (4) Date: Mar. 10, 2010

(87) PCT Pub. No.: WO2009/033655

PCT Pub. Date: Mar. 19, 2009

(65) Prior Publication Data

US 2010/0187748 A1 Jul. 29, 2010

(30) Foreign Application Priority Data

Sep. 11, 2007 (DE) ..... 10 2007 043 130

(51) Int. Cl.
*B65H 1/30* (2006.01)

(52) U.S. Cl. ..... 271/158; 271/159; 271/157; 271/218; 271/3.04

(58) Field of Classification Search ..... 271/157–159, 271/218, 3.04; 414/795.8
See application file for complete search history.

(56) References Cited

U.S. PATENT DOCUMENTS

| | | | | |
|---|---|---|---|---|
| 3,477,324 | A * | 11/1969 | Schwebel | 83/79 |
| 4,390,175 | A | 6/1983 | Takahashi | |
| 5,398,931 | A | 3/1995 | Tohgoh | |
| 5,538,238 | A * | 7/1996 | Filsinger | 271/159 |
| 5,803,446 | A | 9/1998 | Leuthold | |
| 6,334,610 | B1 * | 1/2002 | Minamishin et al. | 271/3.04 |
| 7,748,702 | B2 * | 7/2010 | Auer et al. | 271/159 |
| 7,874,554 | B2 * | 1/2011 | Dopfer et al. | 271/3.04 |
| 2007/0023989 | A1 | 2/2007 | Dopfer et al. | |

FOREIGN PATENT DOCUMENTS

| | | | |
|---|---|---|---|
| DE | 1 249 889 | | 9/1967 |
| DE | 30 28 151 | A1 | 4/1981 |
| DE | 19512505 | A1 | 10/1996 |
| DE | 296 21 095 | U1 | 3/1997 |
| GB | 2 059 390 | A | 4/1981 |
| WO | 2005003005 | A1 | 1/2005 |

OTHER PUBLICATIONS

International Search Report in PCT/EP2008/007427, Feb. 2, 2009.

* cited by examiner

*Primary Examiner* — Michael McCullough
*Assistant Examiner* — Luis A Gonzalez
(74) *Attorney, Agent, or Firm* — Bacon & Thomas, PLLC

(57) ABSTRACT

Apparatus for continuous singling of stacks of loose sheet material, in particular bank notes, vouchers, checks, separation cards, etc., includes a singler for singling stacks of loose sheet material and a feeding device which moves stacks of loose sheet material to be singled into a position where sheet material is grasped by the singler and transferred to a transport system, wherein the feeding device has a first, substantially single-axis moved feeding element and a second, substantially multi-axis moved feeding element. An area for receiving sheet material to be singled and which is divided into a first subarea and a second subarea is provided, wherein the first and second subareas adjoin each other and the second subarea forms an input area for inputting sheet material to be singled.

11 Claims, 4 Drawing Sheets

DEVICE FOR THE SEPARATION OF A SHEET PRODUCT

BACKGROUND

1. Field

This invention relates to an apparatus for continuous singling of stacks of loose sheet material, in particular bank notes, vouchers, checks, separation cards, etc.

2. Related Art

In the processing of bank notes with bank-note processing machines, great importance is attached to the preparation of bank notes to be processed, in particular to the optimally trouble-free insertion of loose bank notes into an input pocket of a singler of the employed bank-note processing machine. Normally, loose bank notes are formed by an operator into stacks which are inserted into the input pocket of the singler for the bank notes to be grasped individually by the singler. The individual bank notes are subsequently processed in the bank-note processing machine. For this purpose, the properties of the bank notes are ascertained by sensors, for example their type, i.e. denomination and currency, their authenticity, their state, i.e. soiling, defects, etc., their suitability for further circulation, their position and orientation, etc. Further processing of the bank notes is effected in accordance with the ascertained properties, e.g. they are sorted into certain output pockets or destroyed by means of a shredder if the bank notes are too damaged or soiled so as to be no longer suitable for further circulation.

If it is necessary to separate different groups of bank notes from each other, e.g. bank notes coming from different depositors, there are inserted so-called separation cards between the bank notes of the different depositors. Said separation cards can be recognized by the sensors of the employed bank-note processing machine in order to separate the bank notes of the different deposits from each other. The separation cards can furthermore have information which can likewise be detected by the sensors and characterizes the different depositors, so that the different deposits can be associated with the particular depositor.

From DE 195 12 505 A1 there is known an apparatus for singling sheet material wherein sheet material to be singled is fed to an input pocket. The input pocket is engaged by two means of rakelike configuration moving vertically and horizontally within the input pocket which permit the singling of sheet material to be effected without interruption, because further sheet material can already be inserted into the input pocket when the previously inserted sheet material has not yet been completely singled. For this purpose, the described means alternatingly engage the input pocket and alternatingly transport sheet material into the singling position.

In the described apparatus it is to be considered disadvantageous, however, that the space for inputting sheet material is limited quite generally to the size of the input pocket, so that only a limited amount of sheet material can be inserted for singling.

From WO 2005/003005 A1 there is known a further apparatus for handling sheet material upon singling. Two means are likewise provided here for feeding sheet material into the singling position. The feeding means are so used that the first feeding means receives a first stack of loose sheet material to be singled in the deposit position and guides it through a single-axis motion within the input pocket into a position where the uppermost sheet of the stack can be grasped by the singler. It thereby continuously feeds the stack decreasing in the course of sheet-by-sheet singling, so that the particular uppermost sheet of the stack can be grasped by the singler and singled. The second, only single-axis movable feeding means is meanwhile located in the deposit position and, during the singling of the first stack, receives a second stack likewise to be singled and to be fed and guides it out of the deposit position into a position where the uppermost sheet of the second stack comes to lie directly below the first feeding means. Thereupon the first stack to be singled and the fed second stack are conjoined by drawing the first feeding means now positioned between the two stacks out of the feeding path. Subsequently the first feeding means is inserted into the feeding path at the position of the second feeding means on a loop path and thus takes over the conjoined stack from the second feeding means. The second feeding means can now return to the deposit position through another single-axis motion on the feeding path to receive the next stack to be singled.

In this apparatus it is only possible to form stacks of small size in order to insert them into the input pocket of the feeding mechanism. Moreover, in this apparatus the space for inputting sheet material is also limited quite generally to the size of the input pocket formed by the intermeshing means of the feeding mechanism, so that only limited amounts of sheet material can be inserted.

Starting out from this prior art, the invention is based on the object of specifying an apparatus for continuous singling of stacks of loose sheet material, in particular bank notes, vouchers, checks, separation cards, etc., wherein the intake capacity of the apparatus for inputting sheet material to be singled is substantially increased.

SUMMARY OF THE INVENTION

The invention is based on the finding that in an apparatus for continuous singling of loose sheet material, having a singler for singling stacks of loose sheet material and a feeding device which moves stacks of loose sheet material to be singled into a position where sheet material is grasped by the singler and transferred to a transport system, wherein the feeding device has a first, substantially single-axis moved feeding element and a second, substantially multi-axis moved feeding element, there is provided for receiving sheet material to be singled an area which is divided into a first subarea and a second subarea, wherein first and second subareas adjoin each other and the second subarea forms an input area for inputting sheet material to be singled.

The advantage of the inventive solution consists in the fact that the intake capacity of the input area of the apparatus for continuous singling of sheet material can be substantially increased by the adjoining first subarea, so that substantially more sheet material can be input than to the input area only.

In one development, the first feeding element is so disposed that it can be moved within the total area, i.e. between a first and a third position, but at least within the first subarea, i.e. between a second and the third position.

In another development, the second feeding element is disposed in the second subarea and can be moved within and outside the second subarea, i.e. between the first and second positions.

The developments have the advantage that the first feeding element can transport the entire input sheet material to the singler, if desired. Because the moving range of the second feeding element is limited to the input area, i.e. between the first and second positions, the total feeding device can be of substantially simpler construction, because the second feeding element need not move over the total area, i.e. from first to the third position, whereby the interaction with the first feeding element at the same time ensures that continuous singling can be effected.

In yet another development it is provided to choose the location of the second position, where the input area and the second subarea adjoin each other, such that the insertion of stacks of sheet material to be singled is readily possible.

This development of the invention has the advantage that sheet material can be inserted into the input area of the apparatus in ergonomically favorable fashion. Due to the fact that after the insertion of each stack of sheet material the first feeding element is moved again such that the last sheet of the last inserted stack of sheet material is located at the second position, this advantage can also be maintained upon insertion of larger amounts of sheet material.

BRIEF DESCRIPTION OF THE DRAWINGS

Further embodiments and advantages of the invention will be explained hereinafter with reference to the figures and the description thereof.

Therein are shown

DETAILED DESCRIPTION OF PREFERRED EMBODIMENTS OF THE INVENTION

FIG. 1 shows an embodiment of an inventive apparatus for continuous singling of sheet material at different processing times during the insertion and the singling of sheet material.

Figure 1A:
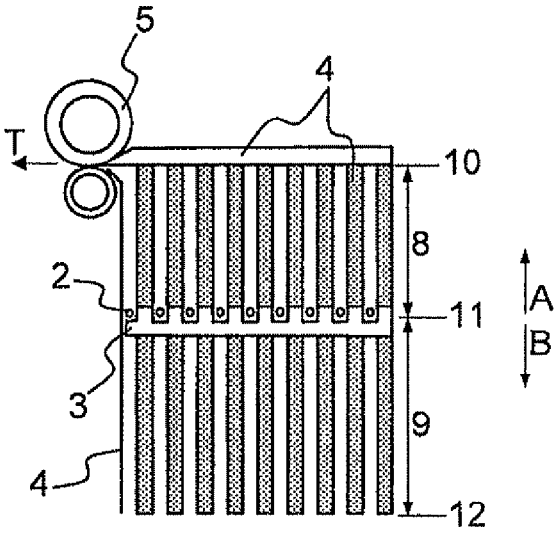
FIG. 1 an embodiment of an inventive apparatus for continuous singling of sheet material at different processing times, and FIG. 2 a machine for processing sheet material, in particular a bank-note processing machine, having an inventive apparatus for continuous singling of sheet material, in particular bank notes.

FIG. 1*a* shows the apparatus for continuous singling of sheet material without sheet material. The apparatus has a singler 5 which grasps sheet material individually and transfers it to a transport system (not shown in detail) which transports the singled sheet material for further processing in a direction indicated by arrow direction T. Limiting and guiding elements 4 form an area 8, 9 in which sheet material to be singled can be present. The limiting and guiding elements 4 can be constructed for example from sheet metal parts. In the area 8, 9 formed by the limiting and guiding elements 4 there is disposed a feeding device comprising two feeding elements 2, 3 which feed bank notes to be singled to the singler 5 for singling. For the sake of simplification and better comprehension, the representation of drive elements, e.g. motors, for the feeding device 2, 3 has been omitted.

The first feeding element 3 serves as a deposit area for sheet material to be singled when the latter is being input to the apparatus. The first feeding element 3 can move along the directions stated as A and B within the area 8, 9, i.e. between a first position 10 and a third position 12, but move at least within a first subarea 9, i.e. between a second position 11 and the third position 12. The second feeding element 2 can move along the directions stated as A and B within a second subarea 8 of the area 8, 9, i.e. between the first and second positions 10 and 11. Additionally, the second feeding element 2 can be moved out of the second subarea 8 forming the input area, for example through a motion into the projection plane of the figure. First and second feeding elements 2 and 3 are configured so that they can intermesh such that the second feeding element 2 can engage between the first feeding element 3 and sheet material deposited thereon when the second feeding element 2 is moved into the second subarea 8. For example, the feeding elements 2, 3 can have comblike structures which are disposed mutually offset.

Figure 1B:
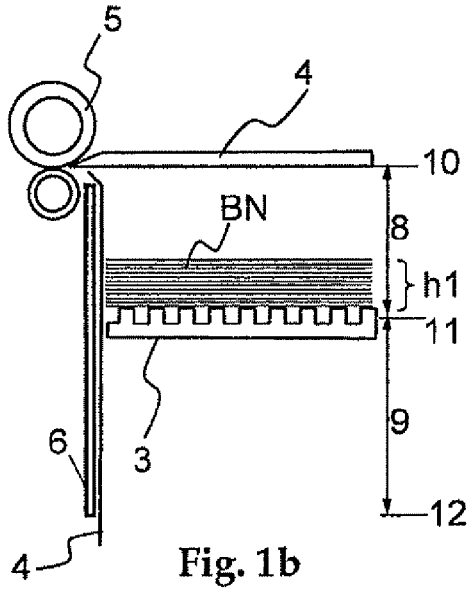

FIG. 1*b* shows the apparatus for continuous singling of sheet material in a starting position before the singling of sheet material. To improve clarity, the limiting and guiding elements 4 are shown only partly therein and in the subsequent figures. The second feeding element 2 has been removed from the second subarea 8 at this time, the first feeding element 3 is located at the second position 11 separating the first and second subareas 8, 9. As a result there is formed in the second subarea 8 an input area between the first and second positions 10 and 11 to which a stack of sheet material BN with a height h1 has been input. By means of a position sensor 6 it is possible to ascertain the particular position of the feeding elements 2 and 3. Additionally, the position sensor 6 can ascertain the height h1 of the particular input stack of sheet material. The position sensor 6 can be configured for this purpose for example as a light barrier which extends substantially over the length of the area 8, 9. The position sensor 6 can also be suited for ascertaining whether an operator is intervening in the second subarea 8 forming the input area, e.g. to insert a stack of sheet material.

Figure 1C:
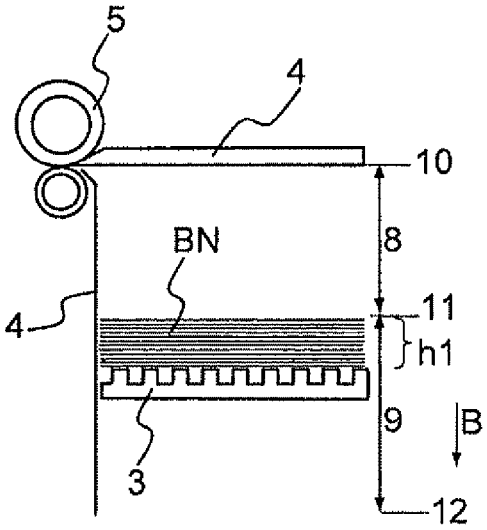

When the position sensor 6 ascertains that the operator has inserted the stack of sheet material with the height h1, the first feeding element 3 is moved in the direction B by the height h1 of the inserted stack of sheet material within the first subarea 9, as shown in FIG. 1*c*, such that the last piece of sheet material of the stack is located at the second position 11. It can be provided that the first feeding element 3 is only moved when the position sensor 6 ascertains that the operator is no longer intervening in the input area. Alternatively, it can also be provided that the operator starts the motion of the first feeding element 3, e.g. by actuating a corresponding operating element.

Figure 1D:
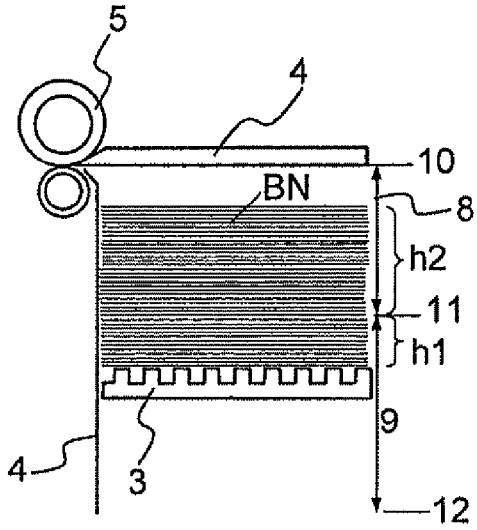

The last piece of sheet material located at the second position 11 now forms the supporting surface for further sheet material to be input, which can e.g. form a stack with a height h2 as shown in FIG. 1*d*.

Figure 1E:
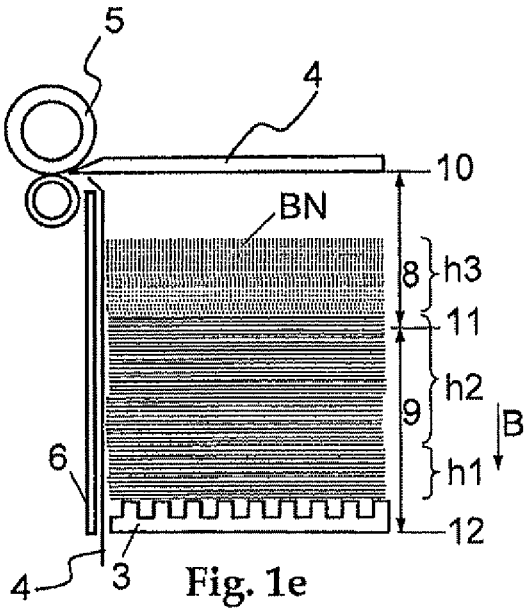

As described hereinabove, the first feeding element 3 is moved again in the direction B, e.g. controlled by means of the signals of the position sensor 6. In accordance with the height h2 of the last inserted stack of sheet material. As shown in FIG. 1*e*, the first feeding element 3 has thus reached the third position 12, which constitutes the end position for the motion of the feeding element 3 in the direction B. In the now vacant input area (second subarea 8) between the first and second positions 10 and 11 there can now be inserted further sheet material, e.g. a stack with a height h3.

Figure 1F:
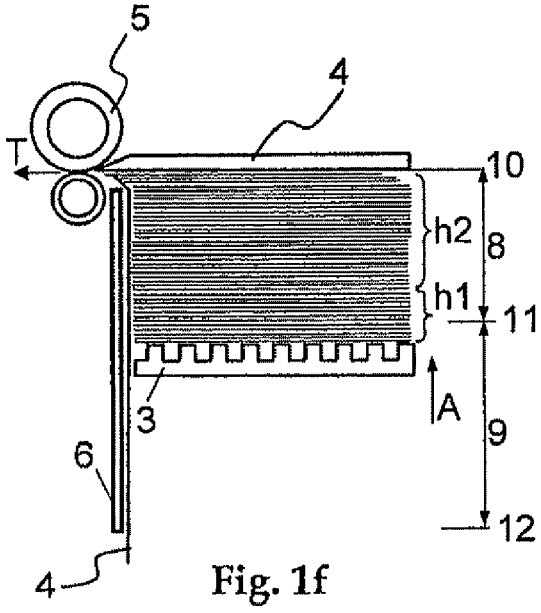

Subsequently the first feeding element 3 is moved in the direction A and the sheet material BN is singled by the singler 5 and transferred to the transport system which transports the individual pieces of sheet material in the direction designated as T for further processing (FIG. 1*f*).

Figure 1G:
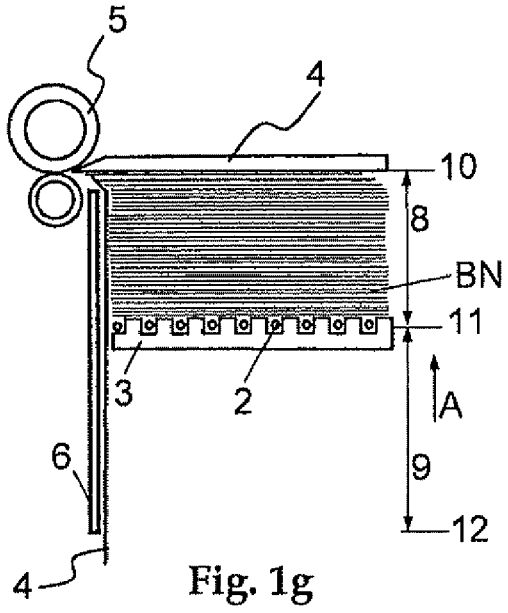
Figure 1H:
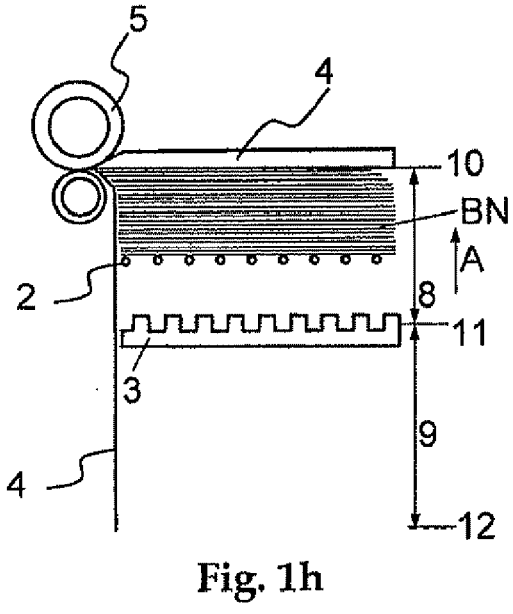

As shown in FIG. 1*g*, the above-described singling is continued until the first feeding element 3 has reached the second position 11. The first feeding element 3 could—as described above—also be moved beyond this position further in the direction A up to the first position 10 to allow the singling of all sheet material BN, but for continuous singling it is provided that the second feeding element 2 is inserted into the second subarea 8 forming the input area (FIG. 1*a*) to take over the further transport of the sheet material to the singler 5. For the sake of completeness it should be mentioned that it is possible that the second feeding element 2 can take over the sheet material from the first feeding element 3 in the described manner at any place within the second subarea 8, i.e. is not limited to taking over at the second position 11.

Figure 1I:
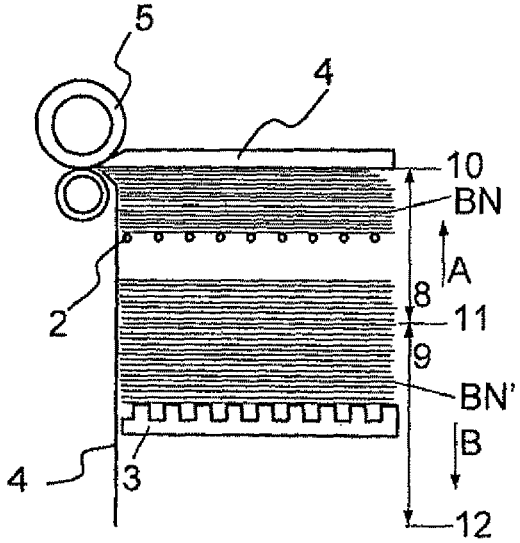

Subsequently the sheet material is moved by the second feeding element 2 in the direction A and fed to the singler 5, while the first feeding element 3 remains at the second position 11. In the area thereby becoming vacant between the first and second feeding elements 2 and 3 (FIG. 1*h*) there can be inserted further sheet material BN' (FIG. 1*i*). As described above, the intake capacity of the input area (second subarea 8 in FIG. 1*a*) can be increased through motion of the first feeding element 3 in the direction B by the first subarea 9, between the second and third positions 11 and 12. During the input of the further sheet material BN' there is effected the feed for continuous singling of the previously input sheet material BN, through the second feeding element 2 which continues to be moved in the direction A.

Figure 1J:
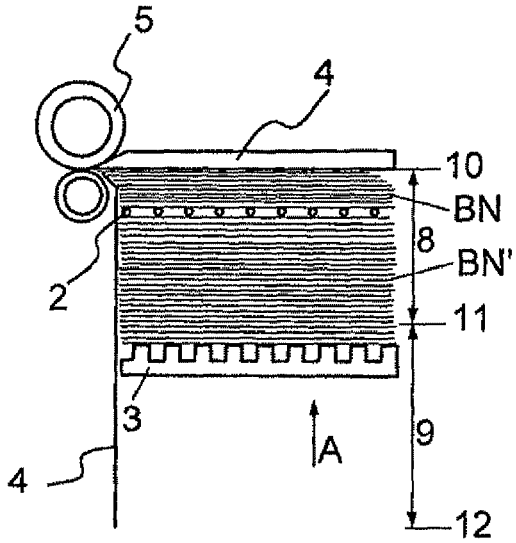

After the termination of insertion of the further sheet material BN', the first feeding element 3 is moved in the direction A toward the second feeding element 2, as shown in FIG. 1*j*. In so doing, there is chosen a greater motion speed for the first feeding element 3 than for the second feeding element 2 until the further sheet material BN' touches the second feeding element 2. Thereafter the first and second feeding elements 3 and 2 move at the same speed.

Figure 1K:
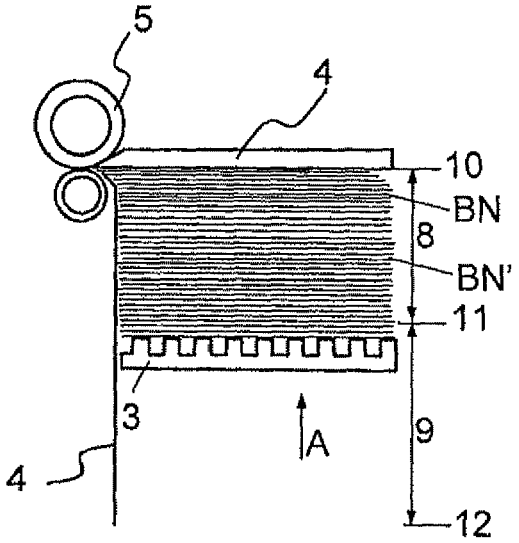
Figure 1L:
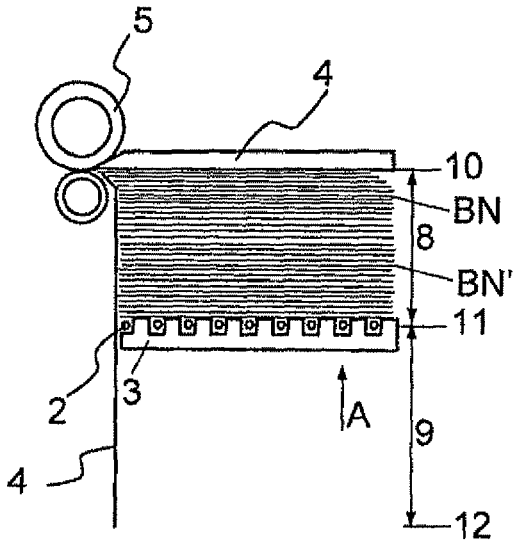

Subsequently, as shown in FIG. 1*k*, the second feeding element 2 is removed from the input area between the first and second positions 10 and 11, whereupon the two stacks of sheet material BN and BN' are conjoined. For further singling, the conjoined stack of sheet material BN, BN' is transported by the first feeding element 3 in the direction A toward the singler 5. The second feeding element 2 is moved outside the input area to the second position 11.

When the first feeding element 3 reaches the second position 11 again (FIG. 11), the sheet material can be taken over by the second feeding element 2 again, by the latter being reinserted into the input area. Continuous singling can thus be continued while new sheet material can be input to the input area. Should no further sheet material be input, the reinsertion of the second feeding element 2 can be omitted and the sheet material can continue to be moved to the singler 5 by the first feeding unit 3.

All in all, the first feeding element 3 is thus reciprocated in single-axis fashion, at least between the second and third positions 11 and 12, whereby a motion up to the first position 10 can also be possible. The second feeding element 2, in contrast, is moved in looplike or multi-axis fashion between the first and second positions 10 and 11, whereby the area between the first and second positions 10 and 11 defines the input area for the inputting of sheet material by the operator. Instead of an operator, the inputting of sheet material can also be effected automatically, for example by means of a robot.

Figure 2:
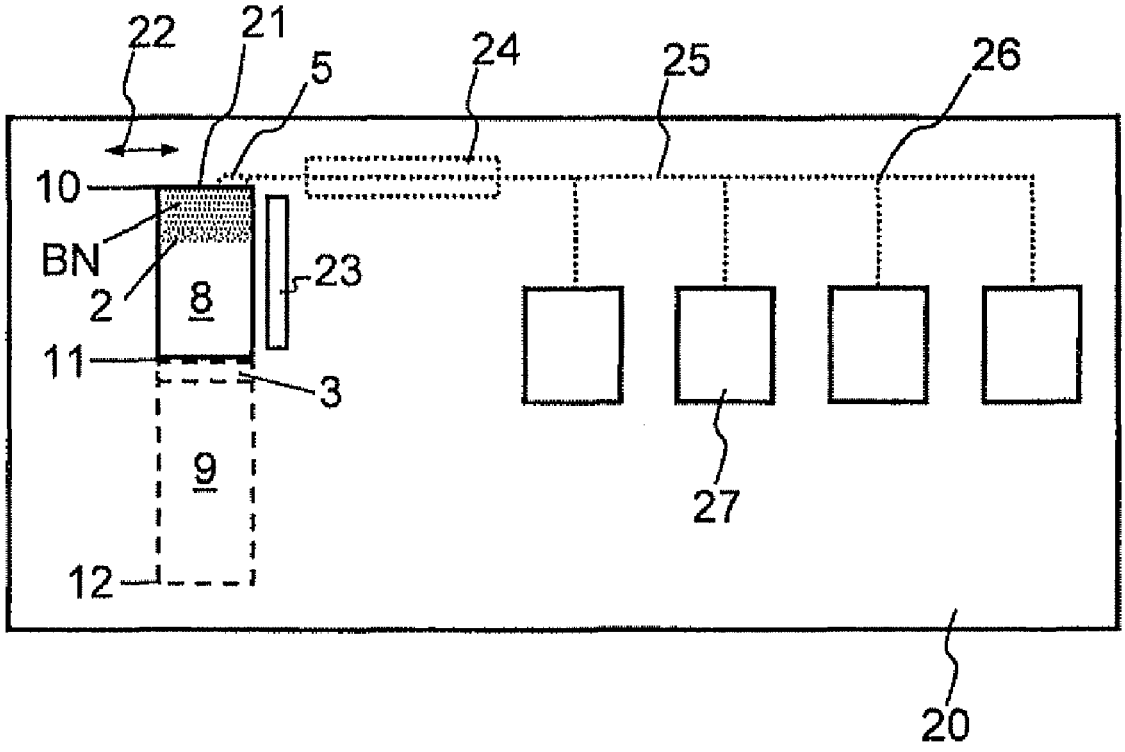

FIG. 2 shows a machine for processing sheet material 20 having an inventive apparatus for continuous singling of sheet material. The machine for processing sheet material can be in particular a bank-note processing machine with which bank notes, vouchers, checks, separation cards, etc., are processed in the above-described way, being in particular checked, sorted and destroyed.

The bank-note processing machine 20 has an input area 8 for inputting bank notes BN. The bank notes BN are singled by a singler 5 and transferred to a transport system 25 which transports the individual bank notes through one or more sensors 24. On the basis of the bank-note signals obtained from the sensor or sensors 24 the particular bank note is checked, it being possible to ascertain for example the authenticity, type (currency, denomination), state (soiling, defects), etc. In accordance with the check, the bank notes are assigned to certain output pockets 27, for which purpose gates 26 in the transport system 25 guide the particular bank note to the certain output pocket or a shredder. For controlling the bank-note processing machine 20 and for evaluating the sensor signals there can be provided a control device (not shown).

Further, the bank-note processing machine has an apparatus for continuous singling of sheet material, in particular bank notes, as described above. The apparatus consists of an input area 8 which forms a second subarea for inputting bank notes and is limited by first and second positions 10 and 11. The second subarea 8 is followed by a first subarea 9 which is limited by the second position 11 and a third position 12. The first and second subareas 9 and 8 are constructed in like manner for receiving bank notes and have in particular the above-described limiting and guiding elements. For feeding bank notes BN to be singled to the singler 5 there is provided a feeding device 2, 3 which consists of first and second feeding elements 3 and 2 and can move both within and outside the first and second subareas 9 and 8. As described above, the first feeding element 3 moves in single-axis fashion at least within the first subarea 9. However, it is also possible that the first feeding element 3 executes its single-axis motion also within the second subarea 8. As likewise described above, the second feeding element 2 carries out a multi-axis, in particular loop-shaped, motion between the first and second positions 10 and 11, whereby a part of the loop-shaped motion is effected outside the second subarea 8. The continuous singling apparatus is likewise controlled by the control device.

For reducing noise caused by the apparatus or the bank-note processing machine 20 there can be provided a cover 21 for the input area 8, which is only opened for bank notes BN to be inserted into the input area 8. For this purpose, there can be present for example a sensor 23 which ascertains the approach of an operator to the input area and in this case opens the cover 21 in the direction 22. With the cover 21 open, it can be provided that the first feeding element 3 does not move as long as the operator is intervening in the input area 8 in order for bank notes to be placed on the first feeding element 3. When the operator has moved out of the detection area of the sensor 23 after inserting a first stack of bank notes into the input area 8, the first feeding element 3 is moved into the first subarea 9 normally inaccessible to the operator in the above-described way such that the last sheet of the stack of sheet material is located at the second position 11. Thereupon the process can be continued as described above and further sheet material inserted.

After the process of inserting sheet material is terminated, the cover 21 can be closed again in the direction 22 for noise reduction. For this purpose, it can be ascertained for example by means of the sensor 23 whether the operator has no longer intervened in the input area for a predetermined time period. Instead of the sensor 23 there can also be provided an operating device for starting the motion of the cover 21 and/or of the first feeding element 3, to be actuated by the operator. Likewise, it can be provided to employ the above-described sensor 6 of the apparatus for singling in place of the just described sensor 23.

Because bank notes input to the input area 8 are transferred to the first subarea 9 adjoining the input area 8, the capacity for receiving bank notes upon inputting of the bank notes to the input area 8 is substantially increased, namely by the first subarea 9. Ideally, the location of the second position 11 is moreover chosen such that it is disposed favorably for the operator from an ergonomic point of view upon inputting stacks of bank notes. This permits the operator to insert large amounts of bank notes into the input area without tiring and with little physical stress, because after the insertion of a stack of bank notes the particular inserted stack is transferred by the first feeding element 3 to the first subarea 9, so that the next stack to be inserted can be inserted at the ergonomically favorable second position 11 again.

The invention claimed is:

1. An apparatus for continuous singling of loose sheet material comprising:

a singler arranged to single stacks of loose sheet material;

a feeding device arranged to move the stacks of loose sheet material to be singled into a position where sheet material may be grasped by the singler and to transport the singled sheets away from the singler, wherein the feeding device comprises a first, substantially single-axis moved feeding element and a second, substantially multi-axis moved feeding element;

an area arranged to receive stacks of loose sheet material to be singled, said area being divided into a first subarea and a second subarea, wherein the first and second subareas adjoin each other, and wherein the second subarea comprises an input area for receiving manually inputted stacks of loose sheet material to be singled; and a first sensor configured to detect a presence of an operator, wherein, upon the first feeding element receiving a first manually inputted stack of loose sheet material and the sensor not detecting the presence of an operator, the first feeding element is lowered in a way such that the first feeding element is arranged to receive additional manually inputted stacks of loose sheet material on top of the first inputted stack of loose sheet material.

2. The apparatus according to claim 1, wherein the first feeding element is disposed in the area and moves within a total area, between a first position and a third position, but at least within the first subarea, between a second position and the third position.

3. The apparatus according to claim 2, wherein the first feeding element is arranged to move inserted stacks of sheet material to the singler at least until the first feeding element reaches the second position, and wherein the second feeding element is arranged to take over the sheet material from the first feeding element at the earliest at the second position to move said sheet material further to the singler.

4. The apparatus according to claim 2, wherein the second position is selected so that the second position adjoins said first and second subareas in a manner that enables insertion of stacks of sheet material to be singled.

5. The apparatus according to claim 1, wherein the second feeding element is disposed in the second subarea and moves within and outside the second subarea, between a first position and a second position.

6. The apparatus according to claim 1, wherein the first feeding element is arranged to move stacks of sheet material inserted into the second subarea into the first subarea from a first position until an upper edge of the inserted stack of sheet material has reached a second position, or the first feeding element has reached a third position.

7. The apparatus according to claim 1, including a second sensor arranged to ascertain at least one of the positions of the first and second feeding elements and the size of the input stacks of sheet material to be singled.

8. The apparatus according to claim 7, wherein a controller controls the motion of the first and second feeding elements in response at least one of to the positions of the first and second feeding elements as ascertained by the second sensor, and the size of the input stacks of sheet material to be singled as ascertained by the second sensor.

9. The apparatus according to claim 1, wherein the input area of the apparatus is closed by a cover, wherein the cover position is moveable away from the input area to uncover the input area for insertion of stacks of sheet material, and a closed position at which the cover closes the input area after termination of the inputting of stacks of sheet material.

10. The apparatus according to claim 9, wherein the motion of the cover is controlled by a second sensor or initiated by means of an operating device.

11. The apparatus according to claim 1, wherein the apparatus is part of a bank-note processing machine.

* * * * *